US005078303A

United States Patent [19]

Kikuchi et al.

[11] Patent Number: 5,078,303

[45] Date of Patent: Jan. 7, 1992

[54] MECHANISM FOR MOUNTING AND REMOVING A TONER CARTRIDGE OF A DEVELOPMENT DEVICE

[75] Inventors: Hiroshi Kikuchi; Kiyoshi Matsuda; Hisao Ono; Yoshiharu Momiyama, all of Tokyo, Japan

[73] Assignee: Oki Electric Industry Co., Ltd., Tokyo, Japan

[21] Appl. No.: 629,553

[22] Filed: Dec. 18, 1990

[30] Foreign Application Priority Data

Dec. 26, 1989 [JP] Japan ..... 1-335070

[51] Int. Cl.[5] ..... B67D 5/64

[52] U.S. Cl. ..... 222/167; 222/325; 222/DIG. 1; 355/260

[58] Field of Search ..... 118/653; 355/260, 245; 222/DIG. 1, 167, 168.5, 169, 171, 172; 221/197, 186, 188, 189, 287

[56] References Cited

U.S. PATENT DOCUMENTS 4,089,601 5/1978 Navone ..... 222/DIG. 1 X
4,611,730 9/1986 Ikesue et al. ..... 222/DIG. 1
4,611,899 9/1986 Kasamura et al. ..... 355/260

FOREIGN PATENT DOCUMENTS 0150767 11/1981 Japan ..... 118/653
0130772 7/1985 Japan ..... 355/260
0294468 12/1986 Japan ..... 355/260

*Primary Examiner*—A. T. Grimley
*Assistant Examiner*—Robert Beatty
*Attorney, Agent, or Firm*—Wenderoth, Lind & Ponack

[57] ABSTRACT

A mechanism for mounting and removing a toner cartridge in a development device for use in an electrophotographic recording apparatus or a photocopier includes a rotating member for mounting a cartridge filled with toner for replenishing onto a main body at a set position and opening a toner opening. A cross-shaped projection on the main body and a cross-shaped groove on the cartridge are provided for preventing lifting of the cartridge when the rotating member is rotated in one direction. The rotating member is rotated from the set position in another opposite direction, and is subsequently returned to the set position to have the projection and the groove engaged or disengaged.

3 Claims, 8 Drawing Sheets

MECHANISM FOR MOUNTING AND REMOVING A TONER CARTRIDGE OF A DEVELOPMENT DEVICE

FIELD OF THE INVENTION

The present invention relates to a mechanism for mounting a toner cartridge for toner replenishment on a main body of a development device in such a manner that the toner cartridge can be freely attached to and detached from the development device main body for supplying toner to a photosensitive member of an electrophotographic recording apparatus, a copier and the like.

BACKGROUND OF THE INVENTION

In electrophotographic recording apparatus, an electrostatic latent image formed on a surface of a photosensitive member by an electrophotography process is developed by toner supplied from a development device, and is then transferred to a recording medium. In the development device of the electrophotographic recording apparatus, a toner cartridge (hereinafter referred to as a cartridge) is removably mounted to a development device main body, and toner is replenished by exchanging the cartridge.

As shown in FIG. 1, the development device 1 comprises a main body 2 and a cartridge 3. As shown in FIG. 3, the main body 2 comprises a cartridge mounting part (hereinafter referred to as mounting part) 4, a toner supply roller 5 and a housing 6. In the mounting part 4, rotating members 8 and 9 which rotate in directions indicated by arrows B-C are provided, having an axis 7 of rotation with respect to the housing 6 and facing each other. The rotating members 8 and 9 are provided with levers 8*a* and 9*a* and joint grooves 8*b* and 9*b*, respectively. A shutter member 10 formed of polyethylene film or the like is provided to span across the rotating members 8 and 9 and is fixed to parts (positioned at the bottom in the state shown in FIG. 1) of the circumferential edges of the members 8 and 9, to block an opening 11 at the bottom of the mounting part 4, as shown in FIG. 2. As shown in FIG. 4, the cartridge 3 comprises a cylinder 12 and revolving members 13, 14 provided at opposite end openings of the cylinder 12, a stopper 15 fixed to the center of the cylinder 12, and toner 16 shown in FIG. 2. The cylinder 12 comprises an outer cylinder 17, and an inner cylinder 18 which is coaxial with the outer cylinder 17, has its outer surface slidably abutting against the inner surface of the outer cylinder 17, and is therefore slidable against the outer cylinder 17. The outer and inner cylinders 17 and 18 are provided with openings 17*a* and 18*a* along part only of their circumference. The revolving members 13 and 14 are fixed to close the opposite end openings of the inner cylinder 18. Provided integrally with the revolving members 13 and 14 are linear joint projections 13*a* and 14*a* which engage with the joint grooves 8*b* and 9*b* on the rotating members 8 and 9. The stopper 15 extending semi-circularly along the outer side of the outer cylinder 17 is fixed to the central part of the outer cylinder, and its opposite ends 15*a* and 15*b* are in abutment with edges 6*a* and 6*b* of the casing 6 of the mounting part 4.

Operation will now be described. First, as shown in FIG. 3, the levers of the rotating members 8 and 9 are rotated in the direction of arrow C. The rotating members 8 and 9 stop when they abut with stoppers, not shown. At this moment, the joint grooves 8*b* and 9*b* are vertical. The cartridge 3 is placed such that its axis is parallel with the axis of the mounting part 4, and is pressed in, with the joint projections 13*a* and 14*a* being engaged with the joint grooves 8*b* and 9*b*. The cartridge 3 is thus set in the main body 2, as shown in FIG. 1. The bottom part of the cartridge 3 is in contact with the shutter member 10, as shown in FIG. 2, and the ends 15*a* and 15*b* of the stopper 15 abut against the edges 6*a* and 6*b* of the casing 6. Then, with the outer cylinder 17 being pressed, the levers 8*a* and 9*a* of the rotating members 8 and 9 are rotated in the direction of arrow B shown in FIG. 3. Since the joint projections 13*a* and 14*a* of the cartridge 3 are engaged with the joint grooves 8*b* and 9*b* of the rotating members 8 and 9, the revolving members 13 and 14 are rotated in the direction of arrow B. The inner cylinder 18 fixed to the revolving members 13 and 14 is therefore rotated in the direction of arrow B. The shutter member 10 fixed to the rotating members 8 and 9 is also rotated in the direction of arrow B. On the other hand, since the end 15*a* of the stopper 15 fixed to the outer cylinder 17 is in abutment with the edge 6*a* of the casing 6 as shown in FIG. 2, the outer cylinder 17 is not rotated.

When the opening 18*a* of the inner cylinder 18 comes to the position at which it overlaps or aligns with the opening 17*a* of the outer cylinder 17, the levers 8*a* and 9*a* abut against stoppers, not shown, and stop. The shutter member 10 also rotates, together with the rotating members 8 and 9, in the direction of arrow B and the opening 11 at the bottom of the mount part 4 is unblocked. The toner 16 that is contained in the inner cylinder 18 passes through a toner opening comprising the openings 18*a*, 17*a* and 11 and is supplied to the main body 2.

For removing the cartridge 3 from the mounting part 4, the levers 8*a* and 9*a* of the rotating members 8 and 9 are rotated in the direction of arrow C as shown in FIG. 3 until abutment with stoppers, not shown. The inner cylinder 18 rotates with the rotating members 8 and 9 in the direction of arrow C, and the opening 18*a* of the inner cylinder 18 completely ceases to overlap the opening 17*a* of the outer cylinder 17. The shutter member 10 blocks the opening 11, and the toner opening is blocked. Then, the joint grooves 8*b* and 9*b* of the rotating members 8 and 9 are vertically aligned, so the cartridge 3 can be removed from the mounting part 4.

In the cartridge mounting/removal mechanism in the related art development device, the inner cylinder 18 slides in contact with the outer cylinder 17, so a frictional force is created in the direction of the tangent of the abutting circumferential surfaces. For instance, for supplying the toner in the cartridge to the main body, the inner cylinder 18 is made to slide, as shown in FIG. 5, in the direction of arrow B while in contact with the inner surface of the outer cylinder 17. At the points of sliding D and E between the outer cylinder 17 and the inner cylinder 18, frictional forces F act on the inner cylinder 18 in the directions of tangents as indicated by the solid line arrows, whereas reactive force F′ which are equal to but opposite to the frictional forces F act on the outer cylinder 17, as indicated by broken line arrows. As a result, a moment acts on the cartridge at the sliding points D and E, about an abutment point G between the end 15*a* of the stopper fixed to the outer cylinder 17 and the edge 6*a* of the casing 6. If the distances from the abutment point G to the sliding points D and E are denoted by L1 and L2, at the sliding points D and E, the outer cylinder 17 receives moments F'×L1, and F'×L2, respectively. The difference M in the moment:

$$M = F' \times L1 - F' \times L2$$

acts on the cartridge as a rotary moment, tending to rotate the cartridge in the direction of arrow H. Actually, the sum of all the rotary momemts over the entire sliding surfaces determines the net effect.

When the cartridge 3 is removed from the mounting part 4, the inner cylinder 18 is rotated in the direction of arrow C, so for a reason similar to that described above, a moment in the direction of arrow J acts on the cartridge about an abutment point I between the end 15*b* of the stopper 15 and the edge 6*b* of the casing 6.

Since the rotating members 8 and 9 of the main body 2 and the revolving members 13 and 14 of the cartridge 3 are engaged by linear grooves and projections, when a rotary moment acts, the cartridge not only rotates in the direction of arrow H or the arrow J, but also is lifted. When the cartridge 3 is lifted, toner is scattered, and the main body 2 is soiled. In order to prevent the lifting of the cartridge 3, the operator must press the cartridge 3 when he rotates the lever of the main body. This is achieved for instance by pressing the cylinder 12 with his thumb and simultaneously rotating the lever with his forefinger. If the cylinder of the cartridge 3 is pressed with the thumb, since the cylinder is thin, it is deformed, and the inner cylinder becomes difficult to rotate.

SUMMARY OF THE INVENTION

An object of the present invention is to provide a development device in which, even when a rotary moment acts on the cartridge about an abutment point G or I at the time of mounting and removal of the cartridge on and from the mounting part, the cartridge is prevented from being lifted.

To achieve the above object, a joint means comprises a cross-shaped projection provided on the rotating member, and a cross-shaped groove provided on the revolving member. The projection and the groove are loosely engaged at a set position, and the rotating member is rotated in one direction and is subsequently returned to the set position to have the projection and the groove engaged with each other, or disengaged from each other, for mounting and removal. At the time of setting the cartridge to a position for supplying toner to the main body, lifting of the cartridge is prevented even when a lifting force acts due to the rotary moment created when the rotating members are rotated. It is therefore not necessary to press the cylinder of the cartridge, and the inner cylinder can rotate smoothly against the outer cylinder. Moreover, since lifting is prevented, scattering of the toner is prevented.

For automatic engagement and disengagement of the projection and the groove, there may further be provided a biasing member which, when the rotating member is rotated in one direction from the set position, applies a biasing force in the other direction, and a rotating means for rotating the rotating member in said one direction at the time of loosely engaging the projection with the groove, and stopping the rotating member at the set position.

With this arrangement, the engagement and disengagement between the cross-shaped groove in the revolving member and the cross-shaped projection on the rotating member can be automatically achieved and can be visually confirmed. The cartridge mounting/removing mechanism is therefore easy to manipulate.

DETAILED DESCRIPTION OF THE PREFERRED EMBODIMENTS

Embodiments of the invention will now be described with reference to the drawings.

FIRST EMBODIMENT

Figure 1:
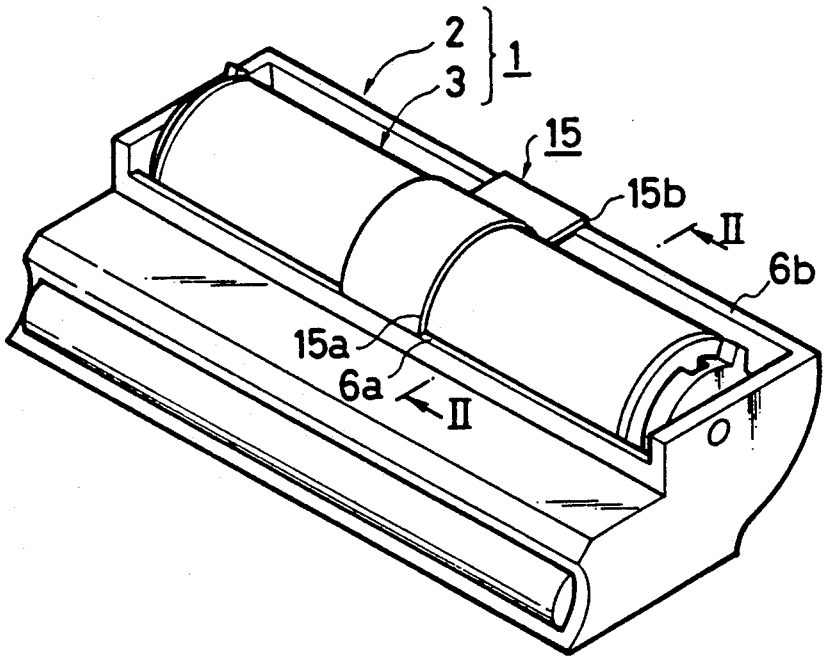
FIG. 1 (PRIOR ART)
FIG. 1 is a perspective view of a prior art example of a mechanism for mounting and removing a cartridge.
Figure 2:
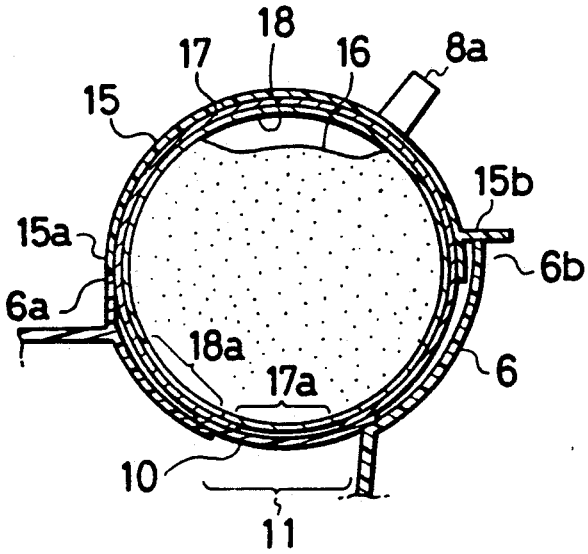
FIG. 2 (PRIOR ART)
FIG. 2 is a sectional view along line II-II in FIG. 1.
Figure 3:
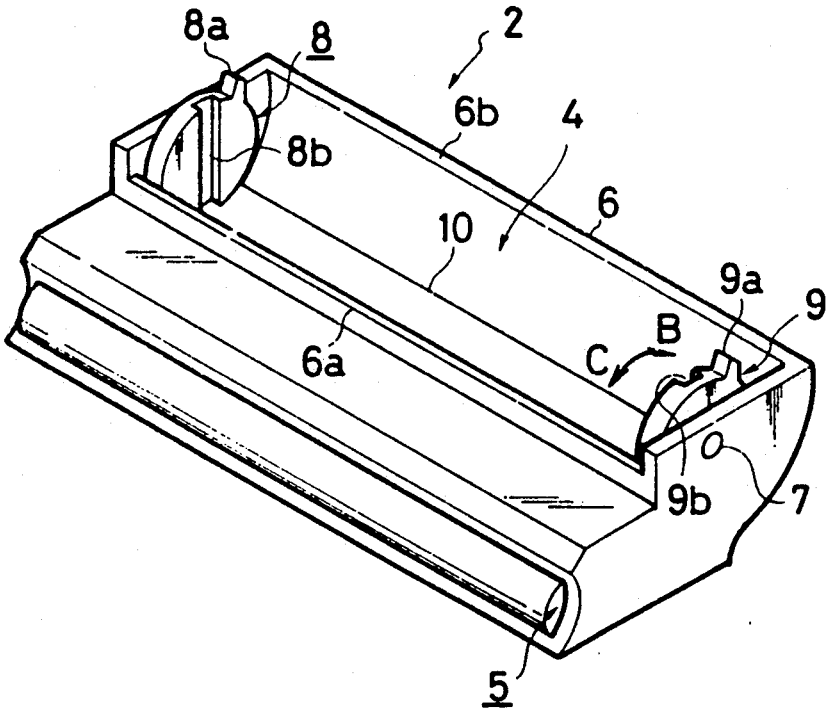
FIG. 3 (PRIOR ART)
FIG. 3 is a perspective view of a main body.
Figure 4:
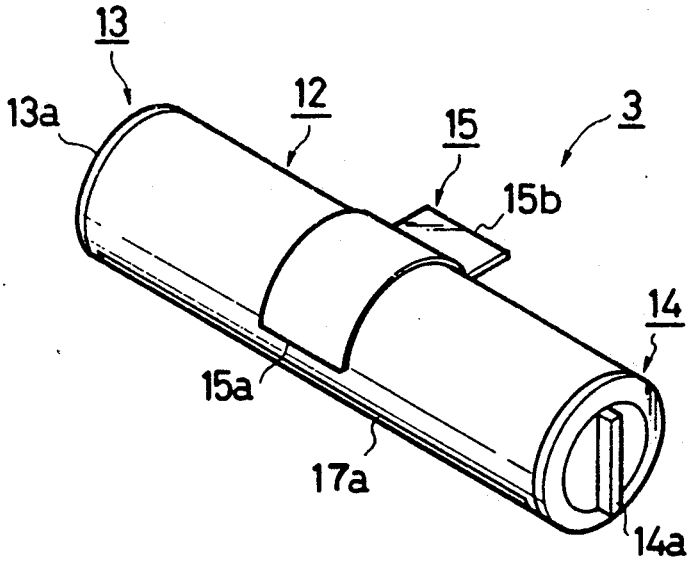
FIG. 4 (PRIOR ART)
FIG. 4 is a perspective view of the cartridge.
Figure 5:
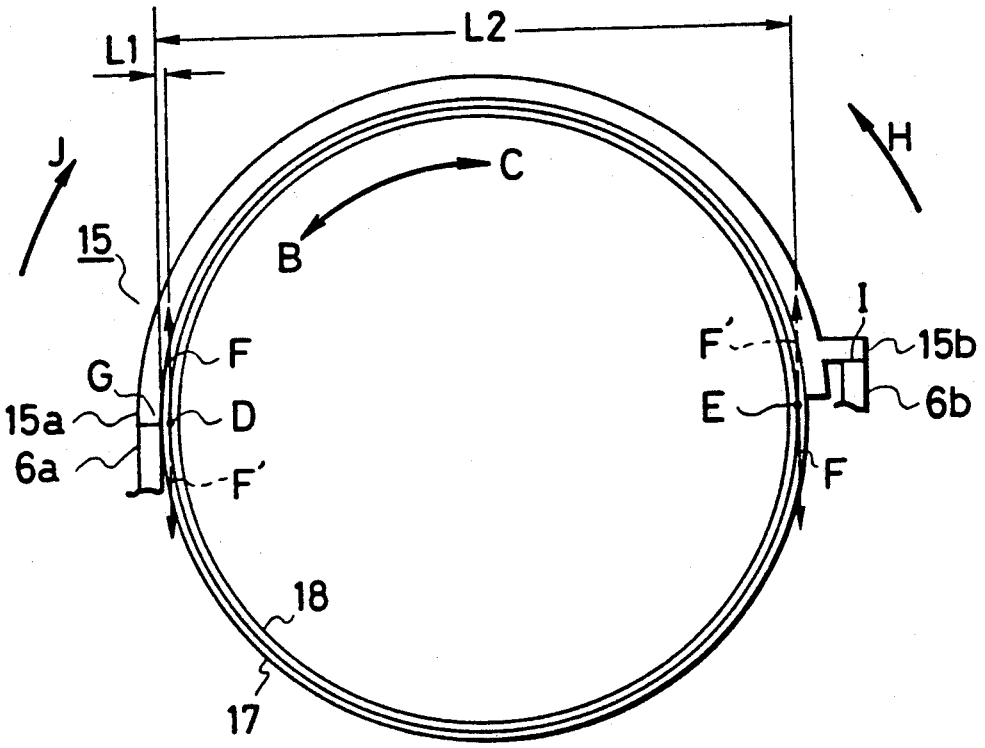
FIG. 5 (PRIOR ART)
FIG. 5 is an explanatory diagram illustrating lifting in such mechanism.
Figure 6A:
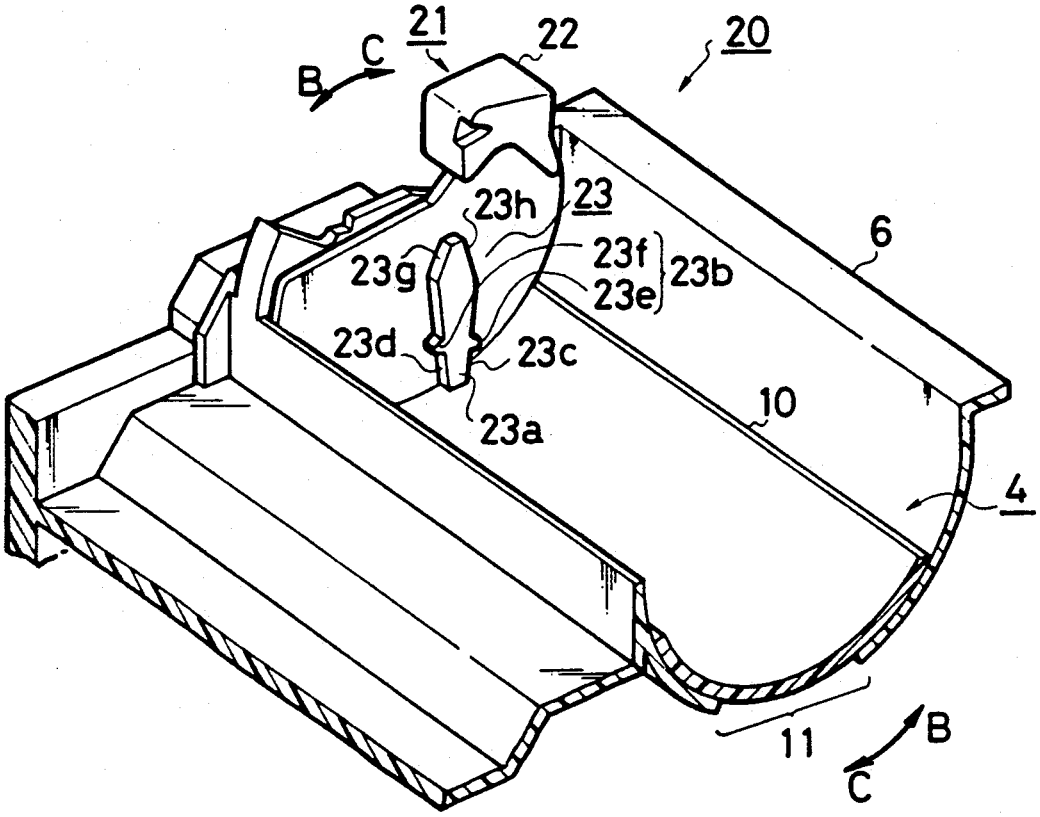
FIG. 6A and FIG. 6B are perspective views of elements of a first embodiment of the invention, with FIG. 6A showing a main body, and FIG. 6B showing a cartridge.
Figure 6B:
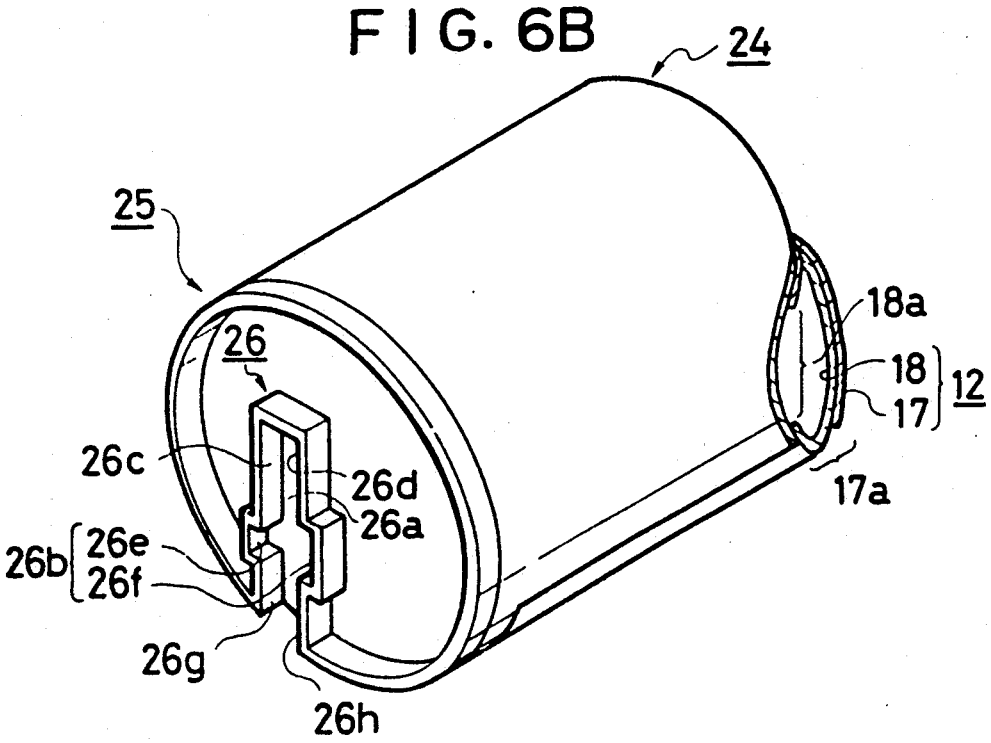
Figure 6C:
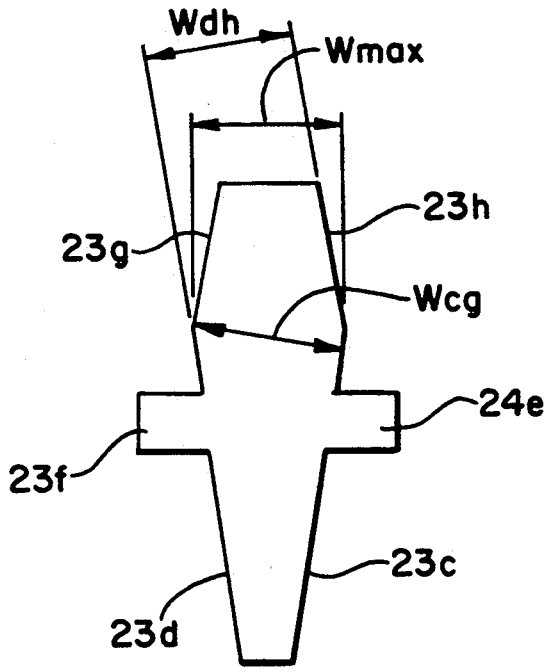
FIG. 6C is a schematic view of a projection of a rotating member.

FIG. 6A and FIG. 6B are perspective views of elements of the first embodiment according to the invention. FIG. 6A shows the characterizing part of the main body with the right half omitted, whereas FIG. 6B shows the characterizing part of the cartridge with the right half omitted. The remaining part of the mechanism is similar to that shown in and described with reference to FIG. 1 to FIG. 5.

As in the case of the prior art, provided on each of opposite ends of a mounting part 4 of a main body 20 is a rotating member 21 having a pivot axis between it and a casing 6. Provided integrally with the rotating member 21 is a cross-shaped joint projection 23 projecting toward the space in which the cartridge is to be positioned when mounted.

The projection 23 comprises a longitudinal main projection 23*a* and a lateral auxiliary projection 23*b* extending at right angles with the main projection 23*a* and intersecting the main projection 23*a* at about the center of the main projection 23*a*.

The main projection 23*a* is tapered toward opposite ends thereof and has a maximum width Wmax at a position slightly above the center in the longitudinal direction of the main projection 23*a*. A distance Wcg between a first pair of side walls 23*c* and 23*g* which are parallel to each other, and a distance Wdh between a second pair of side walls 23*d* and 23*h* which are parallel to each other are both equal to the maximum width Wmax of the main projection 23*a*.

The auxiliary projection 23*b* comprises a first auxiliary projection 23*e* and a second auxiliary projection 23*f* on the respective sides of the main projection 23*a*.

As in the case of the prior art, the cylinder 12 of the cartridge 24 comprises an outer cylinder 17 and an inner cylinder 18. Fixed to each of opposite ends of the inner cylinder 18 is a revolving member 25. The revolving member 25 is provided with a cross-shaped groove 26 which engages, with play, with the projection 23 on the rotating member 21 on the mounting part 4. The groove 26 comprises a main groove **26*a* having one open end, i.e. a lower end where the opening 17*a* is provided, and an auxiliary groove 26*b* extending at right angles with the main groove 26*a* and intersecting the main groove 26*a* at about the center thereof. The main groove 26*a* has side walls 26*c*, 26*d*, 26*g* and 26*h* which are parallel with each other. The side walls 26*c* and 26*g* align with each other. The side walls 26*d* and 26*h* align with each other. The auxiliary groove 26*b* includes a first auxiliary groove 26*e* and a second auxiliary groove 26*f* wider than the first auxiliary groove 26*e* and an upper edge positioned above the upper edge of the first auxiliary groove 26*e***.

The operation will now be described with reference to FIG. 7A to FIG. 7F that are diagrams showing mounting and removal of the cartridge according to the first embodiment and wherein solid lines illustrate the rotating member 21, while chain lines illustrate the revolving member 25.

Figure 7A:
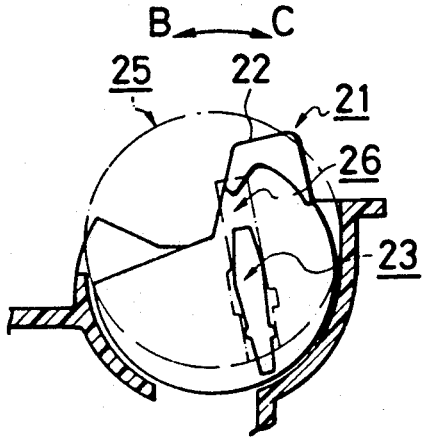
FIG. 7A to FIG. 7F are explanatory diagrams illustrating mounting and removal of the cartridge according to the first embodiment of the invention.
Figure 7B:
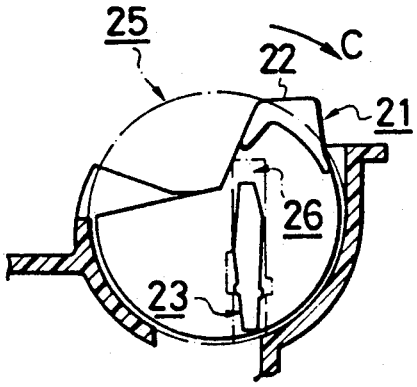
Figure 7C:
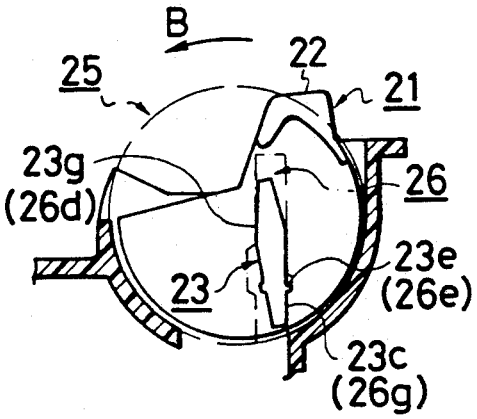

First, a lever 22 of the rotating member 21 is rotated in the direction of arrow C as shown in FIG. 7A until it abuts against a stopper, not shown, and subsequently is returned slightly. The position of the rotating member 21 at this time is the cartridge set position. The cartridge 24 is inserted in the mounting part 4, with the axis of the cartridge 24 being held parallel with the axis of the mounting part 4, and at the same time the grooves 26 of the revolving members 25 on opposite ends of the cartridge are engaged, through their lower openings, with the projections 23 on the rotating members 21. When the cartridge 24 is substantially completely mounted in the mounting part 4, the cartridge 24 is pressed in, while slightly rotating the lever 22 of the rotating member 21 relative to the revolving member 25 in the direction of arrow C, as shown in FIG. 7B. The lever 22 is returned slightly in the direction of arrow B, and then the force for pressing the cartridge 24 is removed. The projection 23 on the rotating member 21 is inclined slightly relative to the groove of the revolving member 25, as shown in FIG. 7C, and the first pair of the side walls **23*c* and 23*g* of the main projection 23*a* abut against the side walls 26*g* and 26*d* of the main groove 26*a*, and the first auxiliary projection 23*e* enters the first auxiliary groove 26*e*. Then, the bottom part of the outer cylinder 17 which is in contact with the shutter member 10 of the mounting part 4 receives an upward force from the bottom part of the mounting part 4, and the projection 23 and the groove 26** are therefore kept engaged (cartridge set).

Figure 7D:
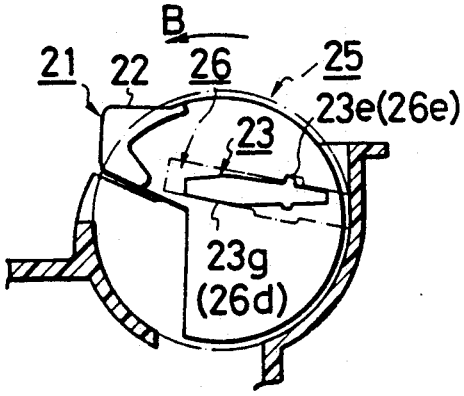

Further, the rotating member 21 is rotated in the direction of arrow B as shown in FIG. 7D until it abuts against a stopper, not shown. The rotating force of the rotating member 21 causes the revolving member 25 to rotate in the direction of arrow B, via the projection 23 and the groove 26. The inner cylinder 18 which is fixed to the revolving member 25 slides while in contact with the inner surface of the outer cylinder 17. The cartridge 24 tends to be lifted from the mounting part 4 by a rotary moment. However, since the first auxiliary projection **23*e* and the first auxiliary groove 26*e* are engaged, the cartridge 24** is prevented from being lifted.

The shutter member 10 fixed to the rotating member 21 shown in FIG. 6A and FIG. 6B, rotates together with the rotating member 21 in the direction of arrow B, and the opening 11 provided in the bottom part of the mounting part 4, the opening **17*a* of the outer cylinder 17, and the opening 18*a* of the inner cylinder 18 overlap each other so that a toner opening comprising the openings 11, 17*a* and 18*a* is opened, and toner in the cartridge 24 is supplied to the main body 2** (cartridge open).

Figure 7E:
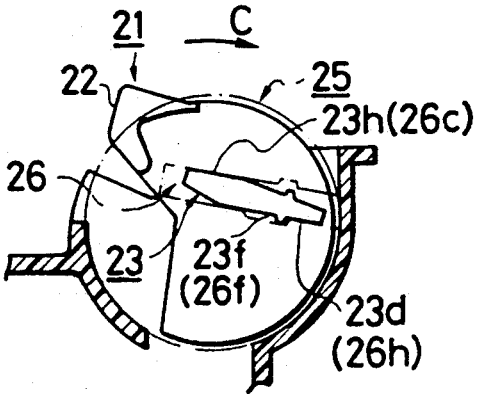
Figure 7F:
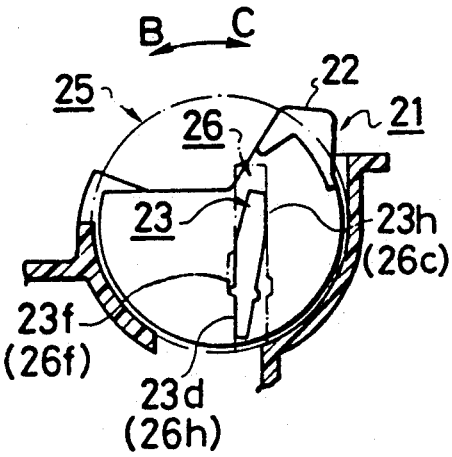

For removing the cartridge 24 from the mounting part 4, the lever 22 of the rotating member 21 is rotated in the direction of arrow C as shown in FIG. 7E. First, the rotating member 21 rotates without being accompanied by the rotation of the revolving member 25. When the second pair of side surfaces **23*d* and 23*h* of the main projection 23*a* abut against the side walls 26*h* and 26*c* of the main groove 26*a*, the second auxiliary projection 23*f* engages with the second auxiliary groove 26*f*. The rotating member 21 is further rotated in the direction of arrow C, as shown in FIG. 7F, until it abuts against a stopper, not shown. The cartridge 24 tends to be lifted from the mounting part 4 because of a rotary moment. However, since the second auxiliary projection 23*f* and the second auxiliary groove 26*f* are engaged, the cartridge 24** is prevented from being lifted.

The shutter member 10 shown in FIG. 6A rotates together with the rotating member 21 in the direction of arrow C, and closes the opening 11 provided in the bottom part of the mounting part 4. The inner cylinder 18 is rotated relative to the outer cylinder 17 in the direction of arrow C, and the openings **17*a* and 18*a* are shifted relative to each other, so that there will be no overlapping, and the toner opening of the cartridge 24** is closed (cartridge close).

Finally, the lever 22 of the rotating member 21 is rotated slightly in the direction of arrow B while pressing the cartridge 24 to the mounting part 4, to remove the force from the cartridge 24. The rotating member 21 rotates in the direction of arrow B, without being accompanied by the rotation of the revolving member 25, and the second auxiliary projection **23*f* is disengaged from the second auxiliary groove 26*f*. The projection 23 becomes parallel with the groove 26, and the cartridge 24 is pushed up by the force pushing up from the bottom part of the mounting part 4, as shown in FIG. 7A**.

As a result, the cross part of the projection 23 and the cross part of the groove 26 are disengaged, and the cartridge 24 can be removed from the mounting part 4.

For removing the cartridge immediately after it is set (i.e., without bringing the cartridge to the position where the toner is supplied to the main body), the lever 22 is rotated slightly in the direction of arrow C from the state shown in FIG. 7C while pressing a cartridge 24. The state shown in FIG. 7B is then achieved, and the cartridge 24 can be easily removed.

SECOND EMBODIMENT

Figure 8A:
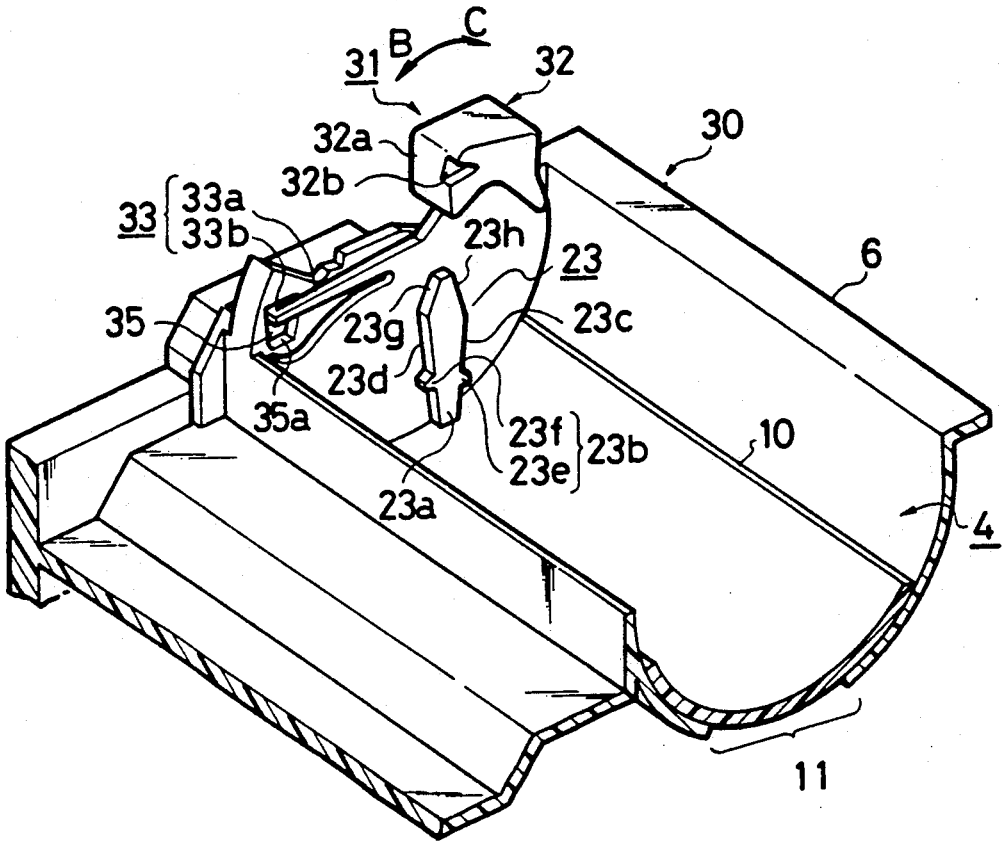
FIG. 8A and FIG. 8B are perspective views of elements of a second embodiment of the invention, with FIG. 8A showing the main body, and FIG. 8B showing the cartridge.
Figure 8B:
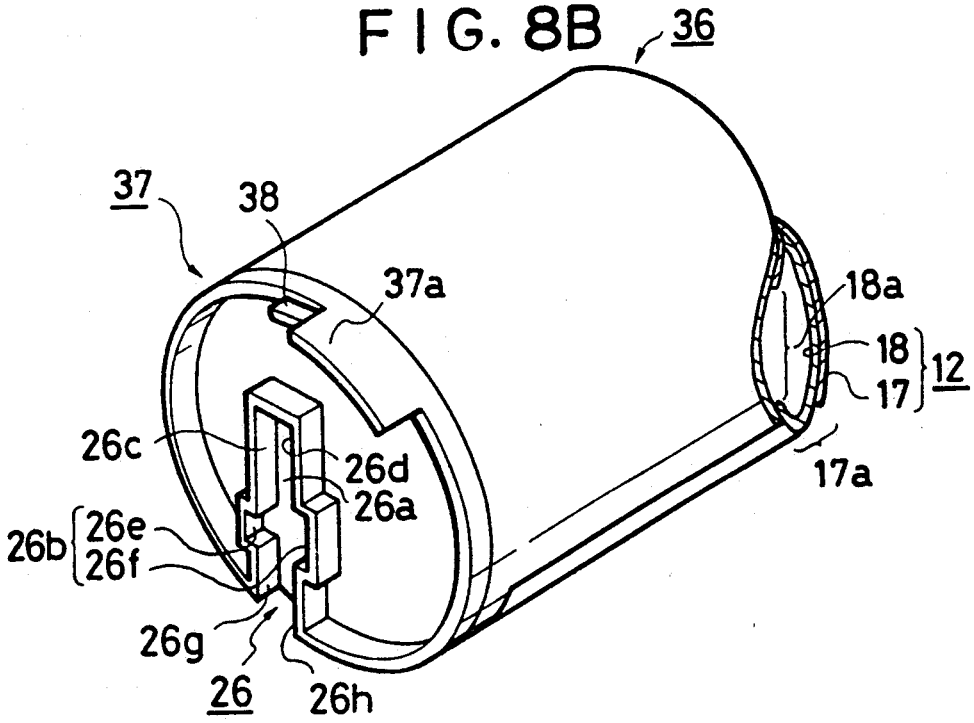

FIG. 8A and FIG. 8B are perspective views of the second embodiment according to the invention. FIG. 8A shows the characterizing part of the main body with the right half omitted, and FIG. 8B shows the characterizing part of the cartridge with the right half omitted.

The difference from the first embodiment is the structure of a rotating member 31 provided in the mounting part 4 in main body 30, and a revolving member 37 provided at each of ends of cartridge 36. Specifically, the rotating member 31 comprises a lever 32, a cross-shaped joint projection 23 projecting toward the space where the cartridge 36 is positioned when mounted in the mounting part 4, and a spring member 33 which are formed integrally with each other. The shape of the projection 23 is identical to that of the first embodiment. The lever 32 has an inclined surface 32*a*, and a V-shaped recess 32*b* opened in the circumferential direction is provided on the inclined surface 32*a*. The spring 33 comprises a longitudinal flexible part 33*a* and, a lateral hook part 33*b*. The hook part 33*b* is in abutment with and slidable along upper edge of a rectangular hole 35. A chamfered edge 35*a* is provided on a lower position of the rectangular hole 35.

The revolving member 37 of the cartridge 36 comprises a joint groove 26 engaging, with play, with the projection 23 of the rotating member 31, and a V-shaped protrusion 38 protruding from a longitudinal extension 37*a* extending from the outer circumference of the revolving member 37. The V-shaped protrusion 37 extends and tapers in the circumferential direction. The shape of the groove 26 is identical to that of the first embodiment.

The inclined surface 32*a* provided on the lever 32 of the rotating member 31 abuts against the V-shaped protrusion 38 when the cartridge 36 is mounted on the mounting part 4 and the rotating member 31 is rotated in the direction of arrow C. At this time, the spring member 33 is energized.

Figure 9A:
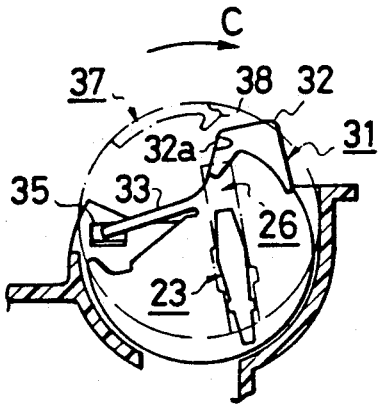
FIG. 9A to FIG. 9F are explanatory diagrams illustrating mounting and removal of the cartridge according to the second embodiment of the invention.
Figure 9B:
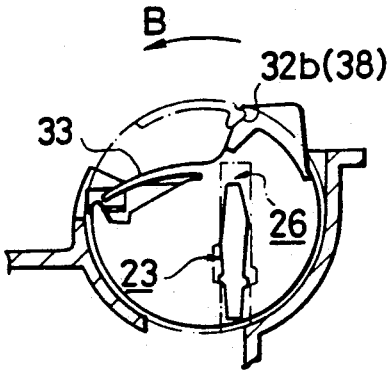
Figure 9C:
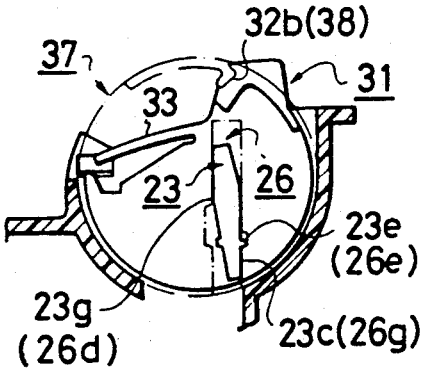

The operation will now be described with reference to FIG. 9A to FIG. 9F that are explanatory diagrams showing mounting and removal of the cartridge according to the second embodiment. The solid lines show the rotating member 31, and the chain show the revolving member 37. As shown in FIG. 9A, the rotating member 31 is at a standstill at a position where the spring member 33 is in abutment with the upper edge of the rectangular hole 35. This position is the waiting position of the cartridge 36. With the groove 26 of the revolving member 37 being engaged with the projection 23 of the rotating member 31, the cartridge is pressed into the mounting part 4. When the cartridge 36 approaches the bottom of the mounting part 4, the V-shaped protrusion 38 of the revolving member 37 is brought to abutment with the inclined surface 32*a* of the lever 32 of the rotating member 31. With the insertion of the cartridge 36, the V-shaped protrusion 38 rotates the rotating member 31 in the direction of arrow C. With the hook part 33*b* sliding along the upper edge of the rectangular hole 35, and the flexible part 33*a* bending as illustrated in FIG. 9B, the spring member 33 imparts to rotating member 31 a restoring force tendency to rotate member 31 in the direction of arrow B. The V-shaped protrusion 38 of the revolving member 37 is brought to engagement with the V-shaped recess 32*b* of the lever 32 as shown in FIG. 9B. When the pressing force is removed from the cartridge 36, the rotating member rotates in the direction of arrow B due to the restoring force of the spring member 33. The bottom part of the outer cylinder 17 is in contact with the mounting part 4, and receives an upward force from the bottom part of the mounting part 4 thereby to be pushed up. During such a process, as described in connection with the first embodiment, and as shown in FIG. 9C, the first auxiliary projection 23*e* of the projection 23 is engaged with the first side groove 26*e*, and the first pair of the side surfaces 23*c* and 23*g* of the main projection 23*a* abut against the first pair of the side walls 26*g* and 26*d* of the groove 26. Concurrently therewith, the V-shaped recess 32*b* of the lever 32 is engaged with the V-shaped protrusion 38 of the revolving member 37, so the operator can visually confirm the completion of the setting of the cartridge 36.

Thus, by pressing the cartridge 36 into the mounting part 4 as described above, the cartridge 36 can be automatically set by the restoring force of the spring member 33.

Figure 9D:
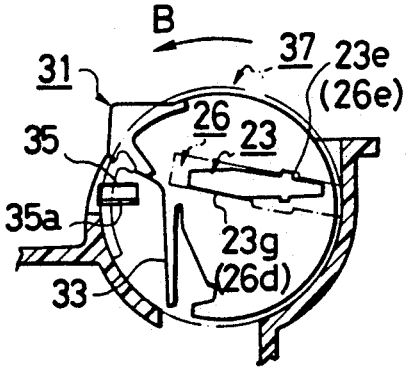

Further, the rotating member 31 is rotated in the direction of arrow B as shown in FIG. 9D. The hook part 33*b* of the spring 33 is moved along the chamfered edge 35*a* of the rectangular hole 35, and is separated from the rectangular hole 35, and rotates together with the rotating member 31 in the direction of arrow B. Then, the cartridge 36 tends to be pushed up (being lifted) from the mounting part 4 because of a rotary moment, but as the projection 23 and the groove 26 are engaged with each other, the pushing-up of the cartridge 36 is prevented (cartridge open). The toner in the cartridge 36 is supplied as in the first embodiment.

Figure 9E:
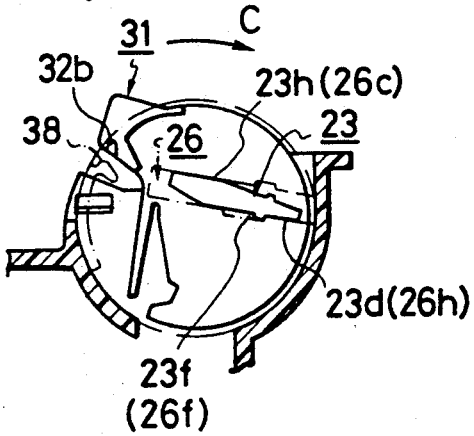
Figure 9F:
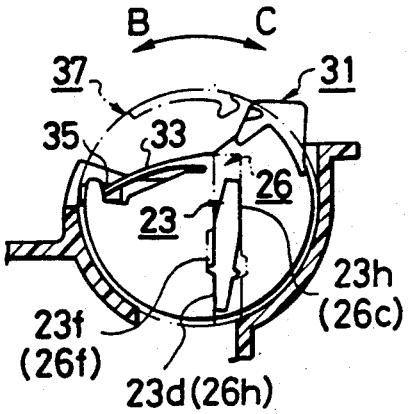

For removing the cartridge 36 from the mounting part 4, the rotating member 31 is first rotated in the direction of arrow C as shown in FIG. 9E. First, the rotating member 31 is rotated in the direction of arrow C without being accompanied by the rotation of the revolving member 37, and the V-shaped recess 32*b* of the rotating member 31 is separated from the V-shaped protrusion 38 of the revolving member 37. The second pair of the side surfaces 23*d* and 23*h* of the main projection 23*a* and the second pair of the side walls 26*h* and 26*c* of the main groove 26*a* are in abutment with each other, and the second auxiliary projection 23*f* is engaged with the second auxiliary groove 26*f*. Further, as shown in FIG. 9F, the rotating member 31 is rotated until it abuts against a stopper, not shown (cartridge closed). Then, the hook part 33*b* of the spring member 33 again abuts against the upper edge of the rectangular hole 35, and the flexible part 33*a* bends, imparting the rotating member 31 with a restoring force tendency to rotate member 31 in the direction of arrow B. When the force on the lever 32 is removed, the rotating member 31 is rotated in the direction of arrow B, without being accompanied by the rotation of the revolving member 37, because of the restoring force of the spring member 33. The revolving member 37 is pushed up by the upward force from the mounting part 4, so the auxiliary projection 23*f* of the projection 23 is separated from the auxiliary groove 26*f* of the groove 26, as shown in FIG. 9A.

In addition, the cartridge 36 is automatically lifted and the operator can visually confirm that the cartridge setting is released, and removal of the cartridge 36 from the mount part 4 is facilitated.

Moreover, when it is desired to remove the cartridge 36 immediately after the cartridge setting, the lever 32 is rotated in the direction of arrow C from the cartridge set state shown in FIG. 9C, and the lever 32 is released (from the hand). Then the operation is as shown in FIG. 9C to FIG. 9B and to FIG. 9A, so that the cartridge 36 is automatically lifted. Thus, removal is facilitated.

In this embodiment, the spring and the revolving member are integral. However, a coil spring, a torsion spring or any other spring mechanism may be separately provided.

In the present embodiment, with regard to the engagement and disengagement of the cross-shaped parts of the projection and the groove, a spring is provided. Accordingly, for the cartridge setting, the cartridge is simply pressed in, and then the cartridge is automatically set. By the action of the combination of the inclined part and the V-shaped protrusion, and the confronting protrusion of the revolving member, the setting of the cartridge is further facilitated, and the completion of setting can be visually confirmed by the operator. Furthermore, during removal of the cartridge, because of the restoring force of the spring, the cartridge is lifted, so the release of the setting can be visually confirmed by the operator, and removal is facilitated. Compared with the first embodiment, the second embodiment is easier to operate.

As has been described, the mechanism for mounting and removing the toner cartridge according to the invention are suitable for use with a development device supplying toner to a photosensitive member in an electrophotographic recording apparatus, photocopiers and the like.

What is claimed is:

1. In a mechanism for mounting and removing a toner cartridge of a development device in which joint means of revolving members provided at opposite ends of a toner cartridge and rotating members provided in opposition to each other in a toner cartridge mounting part of a main body are engaged, and the rotating members are rotated in a first direction to open a toner opening for supplying toner to the main body, the improvement wherein said joint means comprises:

a cross-shaped projection provided on each said rotating member; and a cross-shaped groove provided in each said revolving member and respectively engageable with said cross-shaped projection.

2. A mechanism for mounting and removing a toner cartridge of a development device in which cross-shaped grooves in revolving members provided at opposite ends of a toner cartridge and cross-shaped projections on rotating members provided in opposition to each other in a toner cartridge mounting part of a main body are loosely engaged at a set position of the toner cartridge, and when the rotating members are rotated in a first direction after portions of the grooves and portions of the projections are abutted with each other, a toner opening is opened to supply toner to the main body, wherein:

there is provided a biasing means for generating a biasing force to rotate said rotating members in said first direction when said rotating members are rotated in an opposite second direction from said set position.

3. A mechanism for mounting and removing a toner cartridge of a development device as set forth in claim 2, further comprising means for stopping said rotating members at said set position after rotating said rotating members in said second direction.

* * * * *